US010159617B2

(12) United States Patent
Campbell et al.

(10) Patent No.: US 10,159,617 B2
(45) Date of Patent: Dec. 25, 2018

(54) TABLETOP SECTIONS FOR SURGICAL TABLES

(71) Applicant: Eschmann Holdings Limitted, Lancing, West Sussex (GB)

(72) Inventors: Julie Campbell, Lancing (GB); Mark Portlock, Lancing (GB)

(73) Assignee: Eschmann Holdings Limited (GB)

( * ) Notice: Subject to any disclaimer, the term of this patent is extended or adjusted under 35 U.S.C. 154(b) by 251 days.

(21) Appl. No.: 14/904,143

(22) PCT Filed: Jul. 7, 2014

(86) PCT No.: PCT/EP2014/064473

§ 371 (c)(1),
(2) Date: Jan. 11, 2016

(87) PCT Pub. No.: WO2015/004068

PCT Pub. Date: Jan. 15, 2015

(65) Prior Publication Data

US 2016/0143798 A1 May 26, 2016

(30) Foreign Application Priority Data

Jul. 12, 2013 (GB) ..... 1312522.4

(51) Int. Cl.
*A61G 13/08* (2006.01)
*A61G 7/015* (2006.01)
(Continued)

(52) U.S. Cl.
CPC ..... *A61G 13/08* (2013.01); *A61G 13/1285* (2013.01); *A61G 7/015* (2013.01); *A61G 13/101* (2013.01); *A61G 2203/78* (2013.01)

(58) Field of Classification Search
CPC ..... A61G 7/002; A61G 7/015; A61G 13/02; A61G 13/08; A61G 13/12
(Continued)

(56) References Cited

U.S. PATENT DOCUMENTS 4,159,822 A 7/1979 Ota et al.
5,535,466 A * 7/1996 Snell ..... A61D 3/00 119/753
(Continued)

FOREIGN PATENT DOCUMENTS

EP 0630637 A1 12/1994
EP 0917867 A1 5/1999
(Continued)

OTHER PUBLICATIONS

Search and Examination Report dated May 27, 2016 in corresponding application GB1606240.8.
(Continued)

*Primary Examiner* — Robert G Santos
(74) *Attorney, Agent, or Firm* — Polsinelli PC

(57) ABSTRACT

Tabletop section for a surgical table, the tabletop section including a first connector for connecting the tabletop section to a second tabletop section, the first connector having a hook disposed around a space and defining an opening into the space, and a lock pin for locking the connector to the second tabletop section, the lock pin being movable relative to the hook to change a degree to which the lock pin blocks the opening. The tabletop section has a center of mass between first and second handle portions thereof.

28 Claims, 5 Drawing Sheets

(51) Int. Cl.
*A61G 13/12* (2006.01)
*A61G 13/10* (2006.01)

(58) Field of Classification Search
USPC ..... 5/613, 600, 722, 723, 691, 690, 621
See application file for complete search history.

(56) References Cited

U.S. PATENT DOCUMENTS

| | | | | |
|---|---|---|---|---|
| 5,628,078 | A | 5/1997 | Pennington et al. | |
| 6,195,820 | B1 * | 3/2001 | Heimbrock | A61G 13/12 403/68 |
| 6,336,412 | B2 * | 1/2002 | Heimbrock | A61G 13/12 108/42 |
| 6,698,044 | B2 * | 3/2004 | Greenfield | A61F 5/3776 248/104 |
| 7,669,262 | B2 * | 3/2010 | Skripps | A61G 13/04 5/621 |
| 8,966,687 | B2 * | 3/2015 | Wilson | A61B 6/0442 5/613 |
| 8,997,281 | B2 * | 4/2015 | Daley | A61G 13/129 5/613 |
| 9,615,987 | B2 * | 4/2017 | Worm | A61G 13/1245 |
| 2001/0050033 | A1 * | 12/2001 | Heimbrock | A61G 13/12 108/42 |
| 2002/0170116 | A1 | 11/2002 | Borders et al. | |
| 2003/0182726 | A1 * | 10/2003 | Greenfield | A61F 5/3776 5/648 |
| 2006/0242765 | A1 | 11/2006 | Skripps et al. | |
| 2007/0136947 | A1 | 6/2007 | Limpert | |
| 2010/0235995 | A1 | 9/2010 | Liang | |
| 2011/0277241 | A1 | 11/2011 | Schejbal | |
| 2012/0063838 | A1 | 3/2012 | Sahu et al. | |
| 2012/0205509 | A1 | 8/2012 | Marugg | |
| 2013/0019883 | A1 | 1/2013 | Worm et al. | |
| 2013/0129416 | A1 | 5/2013 | Huggler et al. | |
| 2013/0247301 | A1 * | 9/2013 | Daley | A61G 13/129 5/613 |
| 2013/0312184 | A1 * | 11/2013 | Wilson | A61B 6/0442 5/613 |
| 2016/0143798 | A1 * | 5/2016 | Campbell | A61G 13/08 5/613 |
| 2018/0066689 | A1 * | 3/2018 | Trempert | A61G 13/10 |

FOREIGN PATENT DOCUMENTS

| | | | |
|---|---|---|---|
| JP | 1297054 | | 11/1989 |
| JP | 06114087 | | 4/1994 |
| WO | 200000152 | A1 | 1/2000 |
| WO | 2002023057 | A1 | 3/2002 |
| WO | 2002058617 | A2 | 8/2002 |
| WO | 200303802 | A1 | 4/2003 |
| WO | 2010039102 | A1 | 8/2010 |
| WO | 2013069952 | A1 | 5/2013 |

OTHER PUBLICATIONS

Int'l. Search Report and Written Opinion dated Oct. 28, 2014 in corresponding application PCT/EP2014/064472.
Search and Examiner Report dated Dec. 4, 2013 in corresponding application GB1312307.0.
Int'l. Search Report and Written Opinion dated Jan. 7, 2015 in corresponding application PCT/EP2014/062471.
Int'l. Search Report and Written Opinion dated Mar. 20, 2015 from priority application PCT/EP2014/064473.
Search and Examination Report dated Dec. 4, 2013 from priority application GB1312522.4.
Search and Examination Report dated May 12, 2016 in corresponding application GB1606232.5.

* cited by examiner

TABLETOP SECTIONS FOR SURGICAL TABLES

FIELD OF THE INVENTION

The present invention relates to surgical tables and to tabletop sections therefor.

BACKGROUND

Surgical tables, or operating tables, comprising a base for standing on a floor, a column extending from the base, and a tabletop providing a patient support surface are well known.

In order for surgical tables to be versatile, it is necessary for the tabletop to be disposable in a variety of different configurations. It is known to provide a surgical table with a tabletop that is divided into multiple separate tabletop sections, which are detachable from the table to enable replacement of one or more of the tabletop sections with a different form of tabletop section. Accordingly, different combinations of tabletop sections can be provided to vary the profile of the patient support surface, in order to best support a patient's body for surgery thereon or examination thereof.

SUMMARY OF THE INVENTION

There is a need for a tabletop section having an alternative mechanism for connecting the tabletop section to another tabletop section of a surgical table.

There also is a need for a tabletop section having an improved mechanism for locking the tabletop section to another tabletop section of a surgical table.

There further is a need for a tabletop section that is easier to manipulate during transport.

Still further, there is a need for a tabletop section that is easier to manipulate during connection to, and disconnection from, another tabletop section of a surgical table.

A first aspect of the present invention provides a tabletop section for a surgical table, the tabletop section comprising a first connector for connecting the tabletop section to a second tabletop section, the first connector having a hook disposed around a space and defining an opening into the space, and a lock pin for locking the connector to the second tabletop section, the lock pin being movable relative to the hook to change a degree to which the lock pin blocks the opening.

Optionally, the hook lies in a first plane and the opening is in the first plane.

Optionally, the tabletop section comprises first and second ends extending substantially parallel to a first direction, and first and second sides connecting the first and second ends, each of the first and second sides extending substantially parallel to a second direction perpendicular to the first direction, wherein the first connector is at the first end. Further optionally, the first and second sides comprise respective first and second handle portions.

Optionally, the first direction is normal to the first plane.

Optionally, the lock pin is movable in the first plane relative to the hook to change the degree to which the lock pin blocks the opening.

Optionally, the lock pin is restricted to movement in the first plane relative to the hook to change the degree to which the lock pin blocks the opening.

Optionally, the lock pin is movable linearly relative to the hook to change the degree to which the lock pin blocks the opening.

Optionally, the lock pin is movable in a direction parallel to the second direction relative to the hook to change the degree to which the lock pin blocks the opening.

Optionally, the tabletop section comprises a switch for moving the lock pin relative to the hook to change the degree to which the lock pin blocks the opening.

Optionally, the switch is movable in a direction having at least a component parallel to a third direction perpendicular to each of the first and second directions for moving the lock pin relative to the hook to change the degree to which the lock pin blocks the opening. Further optionally, the switch is movable one of linearly and rotationally. Still further optionally, the switch is movable only one of linearly and rotationally.

Optionally, the first and second handle portions comprise first and second walls defining respective first and second recesses in the first and second sides. Further optionally, the switch is movably located within a hole in the first wall.

Optionally, the switch is movable relative to the first wall between a first position and a second position, wherein when the switch is at the first position a greater degree of the switch is disposed in the first recess than when the switch is at the second position. Further optionally, the switch is biased towards the first position.

Optionally, the lock pin is movable relative to the hook between a first position and a second position, wherein when the lock pin is at the first position the lock pin blocks the opening to a greater degree than when the lock pin is at the second position. Further optionally, the lock pin is biased towards the first position.

Optionally, movement of the switch from the first position to the second position causes movement of the lock pin from the first position to the second position.

Optionally, the tabletop section comprises a second connector for connecting the tabletop section to the second tabletop section, the second connector having a second hook disposed around a second space and defining a second opening into the second space, and a second lock pin movable relative to the second hook to change a degree to which the second lock pin blocks the second opening, wherein the second connector is spaced from the first connector.

Optionally, the second hook lies in a second plane and the second opening is in the second plane.

Optionally, the second plane is parallel to and spaced from the first plane.

A second aspect of the present invention provides a combination of the tabletop section of the first aspect of the present invention and a second tabletop section, wherein the second tabletop section comprises a peg, and wherein the space is for receiving the peg of the second tabletop section.

A third aspect of the present invention provides a tabletop section for a surgical table, the tabletop section comprising first and second ends extending substantially parallel to a first direction, a connector at the first end for connecting the tabletop section to a second tabletop section, the connector comprising a lock pin for locking the connector to the second tabletop section, first and second sides connecting the first and second ends, each of the first and second sides extending substantially parallel to a second direction perpendicular to the first direction, the first and second sides comprising respective first and second handle portions, and a switch at the first handle portion movable relative to the first handle portion for moving the lock pin in a direction parallel to the second direction relative to the first handle portion.

Optionally, the lock pin is restricted to movement in the direction parallel to the second direction.

Optionally, the switch is movable in a direction having at least a component parallel to a third direction perpendicular to each of the first and second directions for moving the lock pin in the direction parallel to the second direction relative to the first handle portion.

Optionally, the switch is movable one of linearly and rotationally. Further optionally, the switch is movable only one of linearly and rotationally.

Optionally, the first and second handle portions comprise first and second walls defining respective first and second recesses in the first and second sides. Further optionally, the switch is movably located within a hole in the first wall.

Optionally, the switch is movable relative to the first wall between a first position and a second position, wherein when the switch is at the first position a greater degree of the switch is disposed in the first recess than when the switch is at the second position. Further optionally, the switch is biased towards the first position.

Optionally, the connector comprises a hook disposed around a space and defining an opening into the space, and the lock pin is movable relative to the hook to change a degree to which the lock pin blocks the opening.

Optionally, the hook lies in a first plane and the opening is in the first plane. Further optionally, the first direction is normal to the first plane.

Optionally, the lock pin is restricted to movement in the first plane.

Optionally, the lock pin is movable relative to the hook between a first position and a second position, wherein when the lock pin is at the first position the lock pin blocks the opening to a greater degree than when the lock pin is at the second position. Further optionally, the lock pin is biased towards the first position.

Optionally, movement of the switch from the first position to the second position causes movement of the lock pin from the first position to the second position.

A fourth aspect of the present invention provides a tabletop section for a surgical table, the tabletop section comprising first and second ends extending substantially parallel to a first direction, a connector at the first end for connecting the tabletop section to a second tabletop section, the connector comprising a lock pin for locking the connector to the second tabletop section, first and second sides connecting the first and second ends, each of the first and second sides extending substantially parallel to a second direction perpendicular to the first direction, the first and second sides comprising respective first and second handle portions, and a switch at the first handle portion movable relative to the first handle portion in a direction having at least a component parallel to a third direction perpendicular to each of the first and second directions for moving the lock pin relative to the first handle portion.

Optionally, the switch is movable one of linearly and rotationally. Further optionally, the switch is movable only one of linearly and rotationally.

Optionally, the first and second handle portions comprise first and second walls defining respective first and second recesses in the first and second sides. Further optionally, the switch is movably located within a hole in the first wall.

Optionally, the switch is movable relative to the first wall between a first position and a second position, wherein when the switch is at the first position a greater degree of the switch is disposed in the first recess than when the switch is at the second position. Further optionally, the switch is biased towards the first position.

Optionally, the lock pin is movable in a direction parallel to the second direction relative to the first handle portion. Further optionally, the lock pin is restricted to movement in the direction parallel to the second direction.

Optionally, the connector comprises a hook disposed around a space and defining an opening into the space, and the lock pin is movable relative to the hook to change a degree to which the lock pin blocks the opening.

Optionally, the hook lies in a first plane and the opening is in the first plane. Further optionally, the first direction is normal to the first plane.

Optionally, the lock pin is restricted to movement in the first plane.

Optionally, the lock pin is movable relative to the hook between a first position and a second position, wherein when the lock pin is at the first position the lock pin blocks the opening to a greater degree than when the lock pin is at the second position. Further optionally, the lock pin is biased towards the first position.

Optionally, movement of the switch from the first position to the second position causes movement of the lock pin from the first position to the second position.

Optionally, in the tabletop section of any one of the first, third and fourth aspects of the present invention, a centre of mass of the tabletop section is between the first and second handle portions.

A fifth aspect of the present invention provides a tabletop section for a surgical table, the tabletop section comprising first and second ends, a connector at the first end for connecting the tabletop section to a second tabletop section, and first and second sides connecting the first and second ends and comprising respective first and second handle portions, wherein a centre of mass of the tabletop section is between the first and second handle portions.

Optionally, the centre of mass is approximately midway between the first and second handle portions.

Optionally, the first and second handle portions comprise first and second walls defining respective first and second recesses in the first and second sides.

Optionally, the first and second ends extend substantially parallel to a first direction and each of the first and second sides extends substantially parallel to a second direction perpendicular to the first direction.

The tabletop section of the fifth aspect of the present invention may comprise any of the above-described optional features of any one of the tabletop sections of the first, third and fourth aspects of the present invention.

Optionally, in the tabletop section of any one of the first, third and fourth aspects of the present invention the second tabletop section is a tabletop section that is disposed upon, and coupled to, a column of a surgical table.

A sixth aspect of the present invention provides a surgical table comprising a tabletop section according to any one of the first, third, fourth and fifth aspects of the present invention.

BRIEF DESCRIPTION OF THE DRAWINGS

Preferred embodiments of the present invention will now be described by way of example only with reference to the accompanying drawings, in which:—

DETAILED DESCRIPTION

Figure 12:
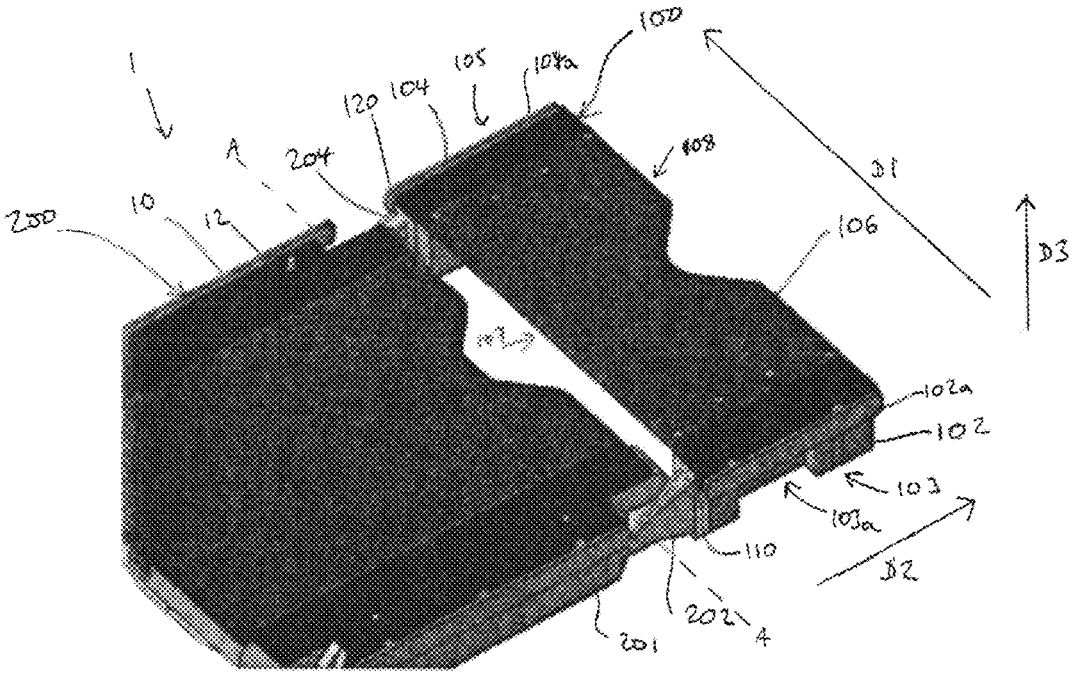
FIG. 12 is partial perspective view of the tabletop section locked to the second tabletop section in the state shown in FIGS. 1 and 7 but with the side panel of the second tabletop section present.

With reference first to FIG. 12, there is shown a tabletop section 100 connected to a second tabletop section 200. The first and second tabletop sections 100, 200 are respective sections of a tabletop 10 of a surgical table 1, which tabletop 10 provides a patient support surface 12. Each of the first and second tabletop sections 100, 200 provides a portion of the patient support surface 12 and, although not shown in the Figures for clarity, would have a respective separate mattress upon which a patient may lie. The second tabletop section 200 is usable to support a portion of the torso of a patient, and the first tabletop section 100 is usable to support a portion of the torso, or the head, of the patient.

Although not shown in the Figures, in the present embodiment the second tabletop section 200 is disposed upon, and is coupled to, the top of a column of the surgical table 1. The column is of adjustable height and extends from a base, which stands on a floor. In a variation to this embodiment, the column is not of adjustable height. The base may include wheels for moving the surgical table along the floor.

Figure 10:
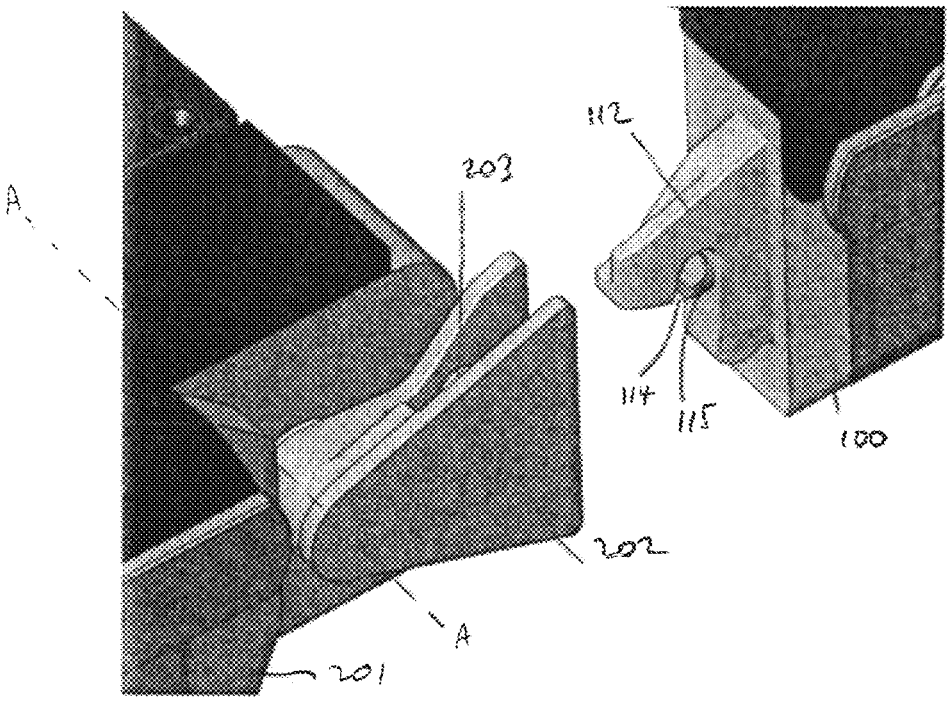
Figure 11:
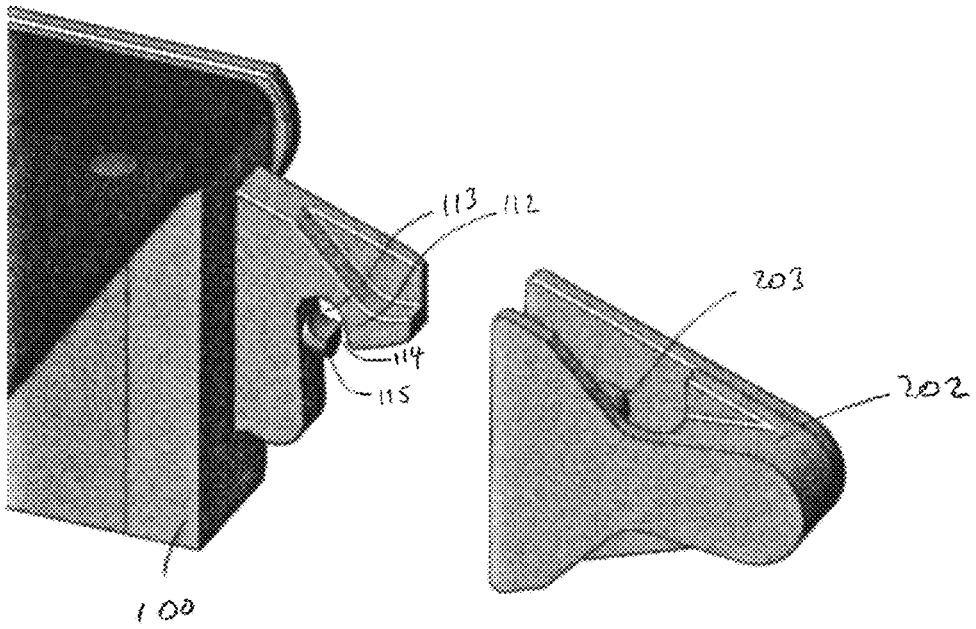

As is more clearly visible in FIG. 10, the second tabletop section 200 has a main frame 201 and first and second connector devices 202, 204 that are pivotally connected to the main frame 201 for rotation about an axis A-A that extends in a transverse direction of the tabletop 10. Moreover, the first and second connector devices 202, 204 are spaced apart in a transverse direction of the table 1. A first end of the first tabletop section 100 is detachably connected, as will be described in more detail below, to the second tabletop section 200 via the first and second connector devices 202, 204, whereby the first tabletop section 100, together with the first and second connector devices 202, 204, is rotatable relative to the main frame 201 of the second tabletop section 200 about the axis A-A. Accordingly, the first and second tabletop sections 100, 200 are disposable in a number of different relative configurations, in order to best support a patient's body for surgery thereon or examination thereof.

In a variation to the illustrated embodiment, the first and second connector devices 202, 204 may be rigidly connected to the main frame 201, so that the first and second connector devices 202, 204 and the first tabletop section 100 are not rotatable relative to the main frame 201 of the second tabletop section 200.

Since the first tabletop section 100 is detachable from the second tabletop section 200, the table 1 may be made compact for storage. Moreover, the first tabletop section 100 may be replaced with a tabletop section of a different form to that shown, for supporting a different portion of a patient.

As used herein, a longitudinal axis of the tabletop 10 is the major axis of the tabletop 10 and a transverse axis of the tabletop 10 is the orthogonal minor axis of the tabletop 10. A longitudinal direction of the tabletop 10 is parallel to the major axis and a transverse direction of the tabletop 10 is parallel to the minor axis. That is, the transverse direction of the tabletop 10 is perpendicular to, or orthogonal to, the longitudinal direction of tabletop 10.

With reference again to FIG. 12, the first tabletop section 100 will now be described in more detail. Broadly speaking, the first tabletop section 100 comprises first and second side members 102, 104 and a plate 106 attached to the tops of, and extending between, the first and second side members 102, 104. To each of the side members 102, 104 is connected a respective bar 102*a*, 104*a*, to which accessories for use in surgery or examination of a patient may be clamped.

The first tabletop section 100 has first and second sides 103, 105 and first and second ends 107, 108, the first and second sides 103, 105 effectively connecting the first and second ends 107, 108. The first and second sides 103, 105 are defined by the first and second side members 102, 104, whereas the first and second ends 107, 108 are defined primarily by the plate 106, but also by opposite longitudinal ends of the first and second side members 102, 104. The first and second ends 107, 108 extend substantially parallel to a first direction (marked as D1 in FIG. 12), which is a transverse direction of the tabletop 10. Moreover, the first and second side members 102, 104 are spaced apart in a direction parallel to the first direction D1 and the plate 106 extends in a direction parallel to the first direction D1 between the first and second side members 102, 104. On the other hand, the first and second sides 103, 105, and the first and second side members 102, 104, extend substantially parallel to a second direction (marked as D2 in FIG. 12), which is a longitudinal direction of the tabletop 10. The second direction D2 is thus perpendicular to the first direction D1.

At the first end 107 of the first tabletop section 100, the first tabletop section 100 comprises first and second connectors 110, 120. Each of the connectors 110, 120 is connected to a respective one of the first and second side members 102, 104, so that the connectors 110, 120 are spaced apart in a direction parallel to the first direction D1. The second connector 120 is substantially the same as the first connector 110, except that it is a mirror image about the longitudinal axis of the tabletop 10. Accordingly, for conciseness, only the first connector 110 will now be described in detail, with reference to FIGS. 1, 2, 8, 10 and 11.

The first connector 110 comprises a hook 112 and a lock pin 115. Although in other embodiments the hook 112 could take a different form, in the illustrated embodiment the hook 112 takes the form of an inverted, or upside-down, J. The hook 112 lies in a first plane, to which first plane the first direction D1 is normal. The hook 112 is disposed around a space 113 in the first plane and defines an opening 114 into the space 113, which opening 114 also is in the first plane. The opening 114 is below the space 113 in normal use of the first tabletop section 100 and the surgical table 1. The space 113 is for receiving a cylindrical peg 203 of the first connector device 202 of the second tabletop section 200, as will be described in more detail below.

The lock pin 115 is for locking the first connector 110 to the second tabletop section 200, more specifically to the first connector device 202 of the second tabletop section 200. The lock pin 115 is moveable linearly in a direction parallel to the second direction D2 within the first side member 102 and relative to the hook 112 to change a degree to which the lock pin 115 blocks the opening 114 in the first plane. Indeed, the lock pin 115 is restricted to movement in a direction parallel to the second direction D2 and in the first plane. The lock pin 115 is movable relative to the hook 112 between first and second positions. In FIGS. 1, 8, 10 and 11, the lock pin 115 is at the first position relative to the hook 112, whereas, in FIG. 2, the lock pin 115 is at the second position relative to the hook 112. From consideration of these Figures it will be appreciated that, when the lock pin 115 is at the first position, the lock pin 115 blocks the opening 114 to a greater degree than when the lock pin 115 is at the second position. The lock pin 115 is biased towards the first position by a biasing device (not shown).

In the illustrated embodiment, the opening 114 is only partially blocked by the lock pin 115 when the lock pin 115 is at the first position. However, in variations to the illustrated embodiment, the opening 114 is fully blocked by the lock pin 115 when the lock pin 115 is at the first position.

Although the second connector 120 will not be described in detail, it is to be noted that the second connector 120 comprises a second hook, a second space and a second opening, corresponding to the hook 112, space 113 and opening 114 of the first connector 110, which second hook, second space and second opening lie in a second plane that is parallel to and spaced from the first plane.

With reference again to FIG. 12, the first and second sides 103, 105 comprise respective first and second handle portions (although only the first handle portion 103*a* of the first side 103 is visible in the Figures). More specifically, the first and second handle portions 103*a* comprise first and second recesses 103*c* in the first and second side members 102, 104 that define the first and second sides 103, 105. Each of the recesses 103*c* is a portion of one of the first and second side members 102, 104 that is recessed from an outer face of the one of the first and second side members 102, 104 towards the other of the first and second side members 102, 104. Each of the first and second recesses 103*c* is defined by a wall 103*b* (only the first wall 103*b* of the first handle portion 103*a* is visible in the Figures) of the respective first and second handle portions 103*a*, which wall 103*b* extends from the outer face of the one of the first and second side members 102, 104 towards the other of the first and second side members 102, 104. Each of the recesses 103*c* can be considered a respective undercut portion of the first tabletop section 100. That is, the recesses 103*c* are located below part of the material forming the respective first and second side members 102, 104 in normal use of the first tabletop section 100 and the surgical table 1.

A centre of mass of the first tabletop section 100 (i.e. the first tabletop section 100 in isolation and disconnected from the second tabletop section 200) is between the first and second handle portions 103*a*. That is, the second direction D2 is normal to a plane that passes through the first and second handle portions 103*a* and through the centre of mass of the first tabletop section 100. Moreover, in the illustrated embodiment, the centre of mass of the first tabletop section 100 is approximately midway between the first and second handle portions 103*a*. Accordingly, the first and second handle portions 103*a* are disposed relative to the rest of the first tabletop section 100 so that a user is best able to manipulate and hold the first tabletop section 100, during transport of the first tabletop section 100 and during connection to and disconnection from the second tabletop section 200, by gripping the first and second handle portions 103*a* with their hands.

Figure 3:
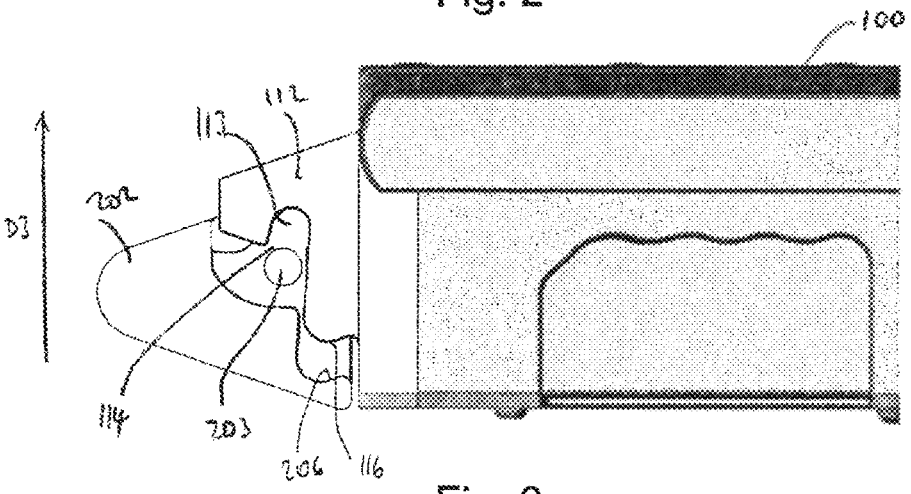
FIG. 3 is a partial side view of the tabletop section of FIG. 2 having been disconnected from the second tabletop section with the switch and the lock pin in their respective second positions.
Figure 4:
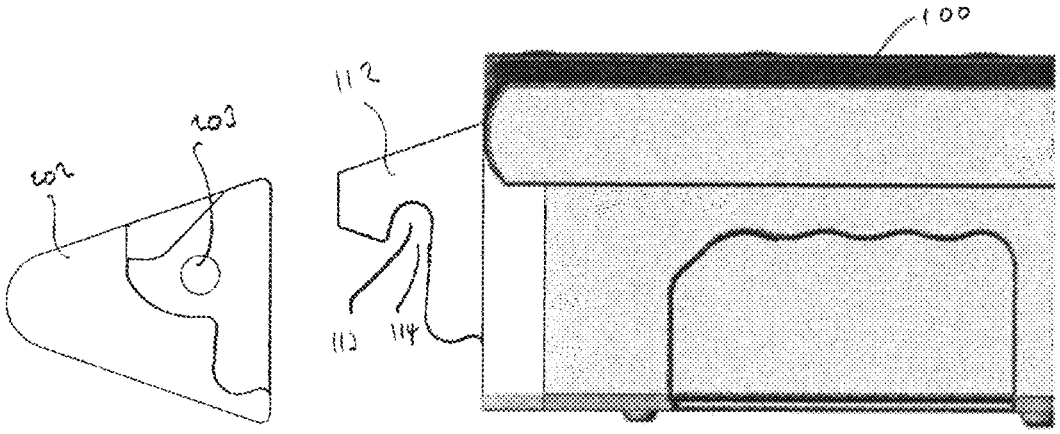
FIG. 4 is a partial side view of the tabletop section of FIG. 3 distanced from the second tabletop section with the switch and the lock pin in their respective second positions.

In the present embodiment, an axis extending in a direction parallel to the first direction D1 and through the first and second handle portions 103*a* passes through the centre of mass of the first tabletop section 100. In variations to the illustrated embodiment, such an axis extending in a direction parallel to the first direction D1 and through the first and second handle portions 103*a* is offset from the centre of mass of the first tabletop section 100 in a direction parallel to a third direction (marked as D3 in FIGS. 3 and 12) perpendicular to each of the first and second directions D1, D2.

The first tabletop section 100 further comprises first and second user-operable switches 109 (although only the first switch 109 at the first handle portion 103*a* is visible in the Figures) at the respective first and second handle portions 103*a*. The first switch 109 is for moving the lock pin 115 of the first connector 110 relative to the hook 112 of the first connector 110 and the first handle portion 103*a*, thereby to change the degree to which the lock pin 115 of the first connector 110 blocks the opening 114 of the first connector 110. The second switch is for moving the second lock pin of the second connector 120 relative to the second hook of the second connector and the second handle portion, thereby to change the degree to which the second lock pin of the second connector blocks the second opening of the second connector. The second switch is substantially the same as the first switch 109 so, for conciseness, only the first switch 109 will now be described in detail.

The first switch 109 is movably located within a hole 103*d* in the first wall 103*b*. More specifically, the hole 103*d* is in a portion of the first wall 103*b* that faces away from the plate 106 (downwards during normal use of the first tabletop section 100 and the surgical table 1), and the first switch 109 is movable linearly in a direction parallel to the third direction (marked as D3 in FIGS. 3 and 12) perpendicular to each of the first and second directions D1, D2 for moving the lock pin 115 relative to the hook 112 to change the degree to which the lock pin 115 blocks the opening 114.

While in the illustrated embodiment the first switch 109 is movable linearly in a direction parallel to the third direction D3, in variations to the illustrated embodiment the first switch 109 may be movable linearly in a direction having only a component parallel to the third direction D3. In some such variations, the movement of the first switch 109 may be in a direction having a component parallel to the first direction D1 or the second direction D2, in addition to the component parallel to the third direction D3. In other such variations, the first switch 109 may be movable rotationally relative to the first wall 103*b*, so that the movement of the first switch 109 may be in a direction having a component parallel to the first direction D1 and/or the second direction D2, in addition to the component parallel to the third direction D3. Such rotational movement of the first switch 109 relative to the first wall 103*b* may be about an axis that extends in a transverse direction of the tabletop 10, i.e. in a direction parallel to the first direction D1.

The first switch 109 is movable relative to the first wall 103*b* between first and second positions. Movement of the first switch relative to the first wall 103*b* from the first position to the second position is in an upwards direction in normal use of the first tabletop section 100 and the surgical table 1. That is, the movement is movement of the first switch 109 towards a plane in which the plate 106 lies, to which plane the third direction D3 is normal.

Figure 1:
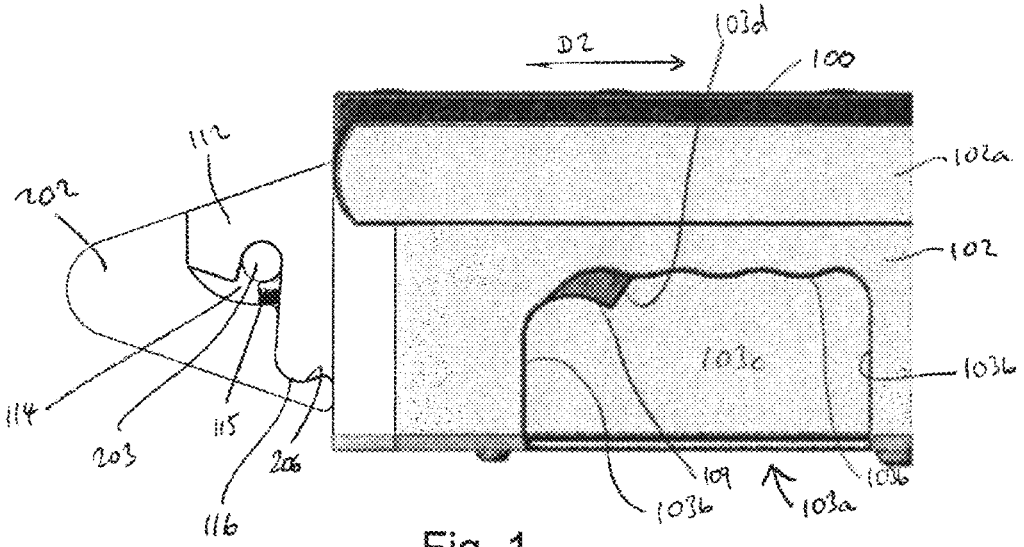
FIG. 1 is a partial side view of a tabletop section in accordance with an embodiment of the present invention locked to a second tabletop section with the switch and the lock pin in their respective first positions, and with a side panel of the second tabletop section removed to show the peg of the second tabletop section and the lock pin of the first tabletop section.
Figure 2:
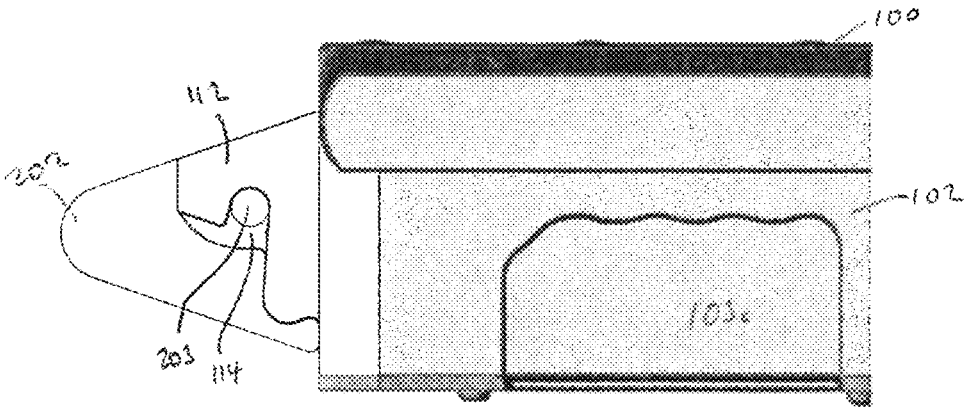
FIG. 2 is a partial side view of the tabletop section of FIG. 1 connected to the second tabletop section with the switch and the lock pin in their respective second positions.
Figure 7:
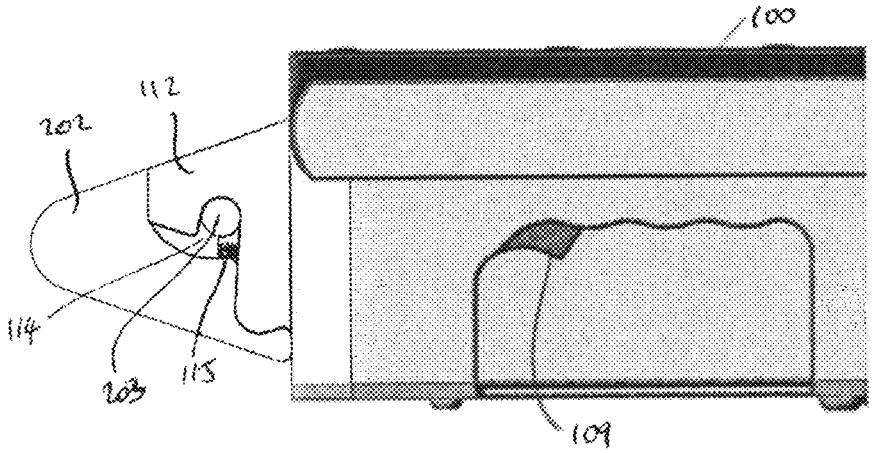
FIG. 7 is a partial side view of the tabletop section of FIG. 6 locked to the second tabletop section with the switch and the lock pin in their respective first positions.

In FIGS. 1 and 7, the first switch 109 is at the first position relative to the first wall 103*b*, whereas, in each of FIGS. 2 to 6, the first switch 109 is at the second position relative to the first wall 103*b*. From consideration of these Figures it will be appreciated that, when the first switch 109 is at the first position, a greater degree of the first switch 109 is disposed in the first recess 103*c* than when the first switch 109 is at the second position. The first switch 109 is biased towards the first position by a biasing device (not shown). Moreover, the first switch 109 is mechanically linked to the lock pin 115 so that movement of the first switch 109 from the first position to the second position of the first switch 109 causes movement of the lock pin 115 from the first position to the second position of the lock pin 115.

It will be appreciated that the second switch (not shown) correspondingly is movably located within a hole in the second wall, is movable in the same manner as the first switch 109, and is mechanically linked to the second lock pin of the second connector 120 so that movement of the second switch from its first position to its second position causes movement of the second lock pin of the second connector 120 from its first position to its second position.

In variations to the illustrated embodiment the second switch may be omitted. In some such variations, the first switch 109 also is mechanically linked to the second lock pin of the second connector 120 so that movement of the first switch 109 from its first position to its second position causes movement of the second lock pin of the second connector 120 from its first position to its second position. In other such variations, the second connector 120 may be omitted, so that the first connector 110 is the only connector of the first tabletop section 100 for connecting the first tabletop section 100 to the second tabletop second 200.

Disconnection and subsequent connection of the first tabletop section 100 to the second tabletop section 200 will now be described with reference to the Figures.

Figure 8:
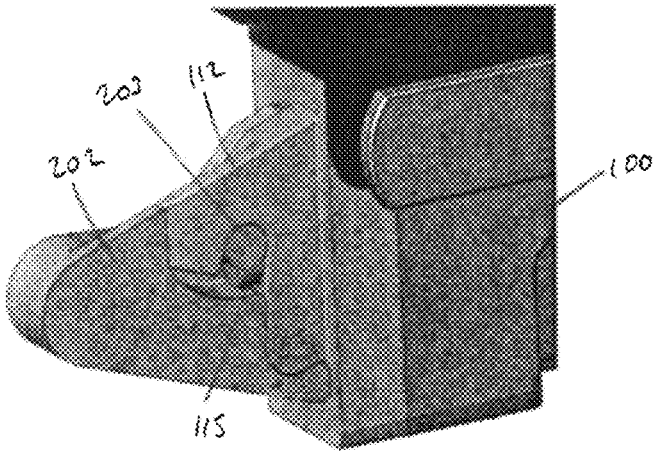
FIG. 8 is a partial perspective view of the tabletop section in the state shown in FIGS. 1 and 7 with the side panel of the second tabletop section removed.
Figure 9:
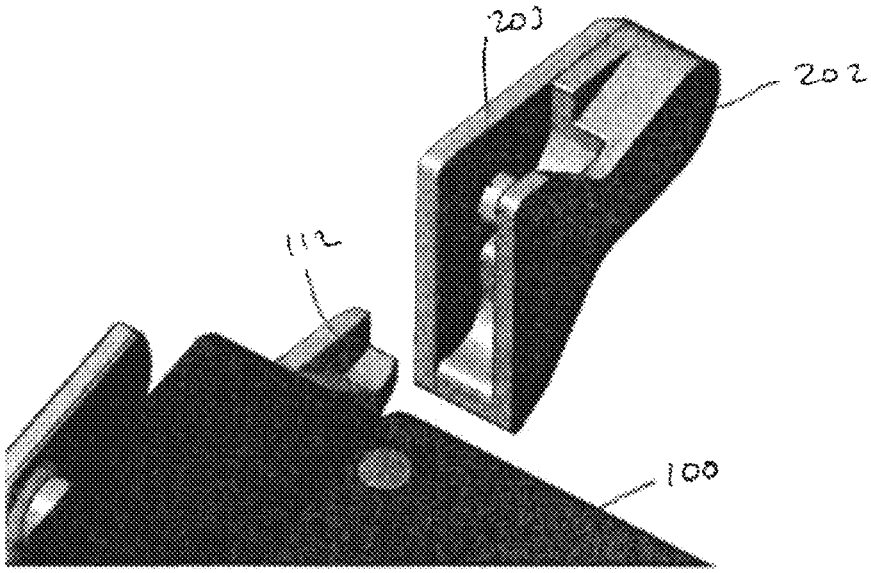
FIGS. 9, 10 and 11 are partial perspective views from respective different angles of the tabletop section of FIG. 4 distanced from the second tabletop section with the switch and the lock pin in their respective first positions but with the side panel of the second tabletop section present.

In FIGS. 1 and 8, the first tabletop section 100 is shown with the switch 109 and the lock pin 115 in their respective first positions. The peg 203 of the first connector device 202 of the second tabletop section 200 is located in the opening 114. Correspondingly, although not shown in the Figures, the second switch and the second lock pin are in their respective first positions, and a second peg of the second connector device 204 of the second tabletop section 200 is located in the second opening of the second connector 120. Thus, the first tabletop section 100 is locked to the second tabletop section 200, since the lock pin 115 blocks the opening 114 to a sufficient degree to prevent removal of the peg 203 from the space 113, and the second lock pin blocks the second opening to a sufficient degree to prevent removal of the second peg of the second connector device 204 from the second space of the second connector 120. Moreover, a downward-facing portion 116 of the hook 12 rests on an upward-facing ledge 206 of the first connector device 202 of the second tabletop section 200. Correspondingly, although not shown in the Figures, a downward-facing portion of the second hook of the second connector 120 rests on an upward-facing ledge of the second connector device 204 of the second tabletop section 200. Accordingly, the first tabletop section 100 is supported by the second tabletop section 200.

In order to unlock the first tabletop section 100 from the second tabletop section 200, a user grasps the first and second handle portions 103*a* with their hands, so that fingers on their respective left and right hands contact the first and second walls 103*b* and the index fingers of their respective left and right hands contact the first switch 109 and the second switch, respectively. The user then moves their index fingers in a direction having at least a component parallel to the third direction D3, so as to move the first and second switches 109, against the bias of the biasing devices (not shown), from their respective first positions to their respective second positions, thereby to move the lock pin 115 of the first connector 110 and the second lock pin of the second connector 120 from their respective first positions to their respective second positions, to reach the state shown in FIG. 2.

Once the lock pins 115 of the connectors 110, 120 are at their respective second positions, the lock pins 115 no longer block the openings 114 to a sufficient degree to prevent removal of the pegs 203 from the spaces 113. Accordingly, the user can then use their fingers to exert a force in a direction having at least a component parallel to the third direction D3, so as to lift the whole first tabletop section 100 from the second tabletop section 200 in a direction parallel to the third direction D3. This movement removes the first and second pegs 203 from the first and second spaces 113 via the first and second openings 114, parts the downward-facing portion 116 of the hook 12 from the upward-facing ledge 206 of the first connector device 202 of the second tabletop section 200, and parts the downward-facing portion of the second hook of the second connector 120 from the upward-facing ledge of the second connector device 204 of the second tabletop section 200, thereby to disconnect the first tabletop section 100 from the second tabletop section 200, to reach the state shown in FIG. 3.

It will be noted that the user does not need to change their grip on the first tabletop section 100 between first moving the first and second switches 109 to their respective second positions and subsequently lifting the whole first tabletop section 100 from the second tabletop section 200. Accordingly, the first tabletop section 100 is easy to manipulate during disconnection from the second tabletop section 200.

Once the first and second pegs 203 have been removed from the first and second spaces 113 of the first and second connectors 110, 120, the user is able to transport the first tabletop section 100 away from the second tabletop section 200, as shown in FIGS. 4, and 9 to 11. Since the user is holding the first tabletop section 100 by gripping the first and second handle portions 103*a* with their hands, and since the centre of mass of the first tabletop section 100 is between the first and second handle portions 103*a*, the first tabletop section 100 is easy to manipulate during transport. At any time after disconnecting the first tabletop section 100 from the second tabletop section 200, the user is able to release the first and second switches 109 to permit the biasing device to move the first and second switches 109 and the first and second lock pins 115 their respective first positions.

The user is able to connect the first tabletop section 100 to the second tabletop section 200 by reversing the order of these steps, as follows.

The user grasps the first and second handle portions 103*a* with their hands, so that fingers on their respective left and right hands contact the first and second walls 103*b* and the index fingers of their respective left and right hands contact the first switch 109 and the second switch, respectively. The user then moves their index fingers in a direction having at least a component parallel to the third direction D3, so as to move the first and second switches 109, against the bias of the biasing devices (not shown), from their respective first positions to their respective second positions, thereby to move the lock pin 115 of the first connector 110 and the second lock pin of the second connector 120 from their respective first positions to their respective second positions, to reach the state shown in FIGS. 4 and 9 to 11.

Figure 5:
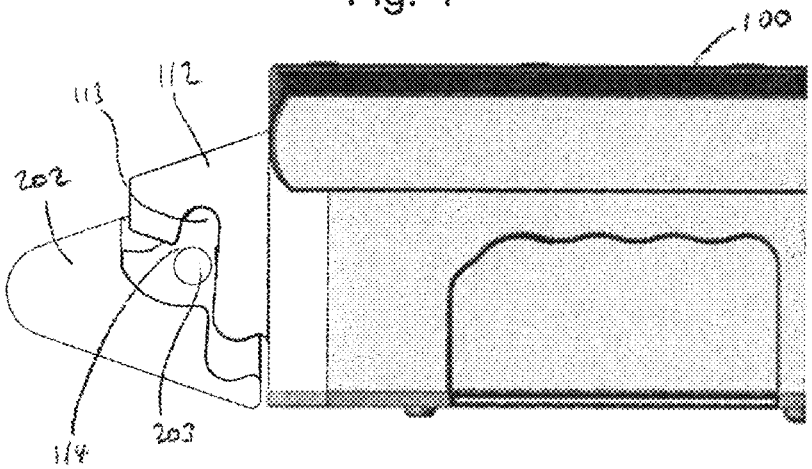
FIG. 5 is a partial side view of the tabletop section of FIG. 4 in the process of being connected to the second tabletop section with the switch and the lock pin in their respective second positions.
Figure 6:
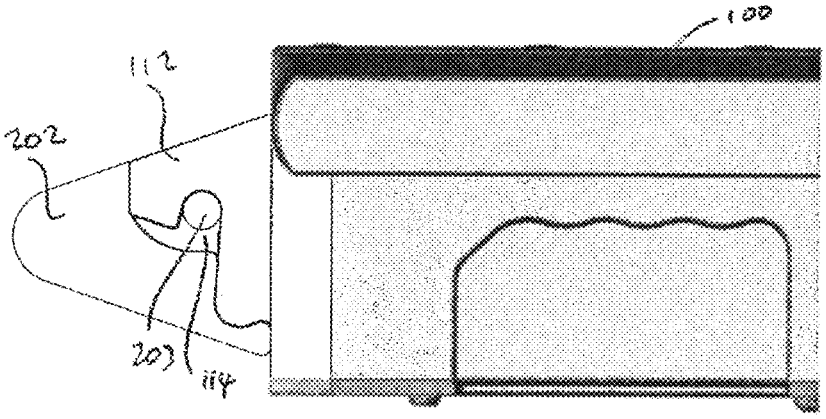
FIG. 6 is a partial side view of the tabletop section of FIG. 5 connected to the second tabletop section with the switch and the lock pin in their respective second positions.

The user then moves the first tabletop section 100 relative to the second tabletop section 200 thereby to align the first and second pegs 203 with the first and second openings 114 of the first and second connectors 110, 120, to reach the state shown in FIG. 5.

With the lock first and second pins 115 of the first and second connectors 110, 120 at their respective second positions, the first and second lock pins 115 do not block the first and second openings 114 to a sufficient degree to prevent movement of the first and second pegs 203 through the first and second openings 114 into the first and second spaces 113. Accordingly, the user can then lower the first tabletop section 100 relative to the second tabletop section 200 in a direction parallel to the third direction D3 to cause the first and second pegs 203 to enter the first and second spaces 113 through the first and second openings 114, to cause the downward-facing portion 116 of the hook 12 to rest on the upward-facing ledge 206 of the first connector device 202 of the second tabletop section 200, and to cause the downward-facing portion of the second hook of the second connector 120 to rest on the upward-facing ledge of the second connector device 204 of the second tabletop section 200, thereby to connect the first tabletop section 100 with the second tabletop section 200, to reach the state shown in FIG. 6.

The user is then able to release the first and second switches 109 to permit the biasing devices to move the first and second switches 109 and the first and second lock pins 115 their respective first positions, to reach the state shown in FIG. 7. The lock pin 115 then blocks the opening 114 to a sufficient degree to prevent removal of the peg 203 from the space 113, and the second lock pin blocks the second opening to a sufficient degree to prevent removal of the second peg of the second connector device 204 from the second space of the second connector 120. Thus, the first tabletop section 100 is locked to the second tabletop section 200.

It will be noted that the user does not need to change their grip on the first tabletop section 100 between first moving the first and second switches 109 to their respective second positions and subsequently connecting the first tabletop section 100 with the second tabletop section 200. Accordingly, the first tabletop section 100 is easy to manipulate during connection with the second tabletop section 200.

Various modifications can be made to the above-described embodiments without departing from the scope of the present invention, which is defined by the claims.

The invention claimed is:

1. A combination of a first tabletop section and a second tabletop section for a surgical table, the first tabletop section comprising a first connector for connecting the first tabletop section to the second tabletop section, the first connector having a hook disposed around a space and defining an opening into the space, and a lock pin for locking the first connector to the second tabletop section, the lock pin being movable relative to the hook to change a degree to which the lock pin blocks the opening, wherein the lock pin is movable linearly relative to the hook to change the degree to which the lock pin blocks the opening, wherein the second tabletop section comprises a peg, and wherein the space is configured to receive the peg of the second tabletop section.

2. The combination of tabletop sections according to claim 1, wherein the hook lies in a first plane and the opening is in the first plane.

3. The combination of tabletop sections according to claim 1, comprising first and second ends extending substantially parallel to a first direction, and first and second sides connecting the first and second ends, each of the first and second sides extending substantially parallel to a second direction perpendicular to the first direction, wherein the first connector is at the first end, optionally wherein the first and second sides comprise respective first and second handle portions.

4. The combination of tabletop sections according to claim 3, wherein the hook lies in a first plane and the opening is in the first plane and wherein the first direction is normal to the first plane.

5. The combination of tabletop sections according to claim 2, wherein the lock pin is movable in the first plane relative to the hook to change the degree to which the lock pin blocks the opening, optionally wherein the lock pin is restricted to movement in the first plane relative to the hook to change the degree to which the lock pin blocks the opening.

6. The combination of tabletop sections according to claim 3, wherein the lock pin is movable in a direction parallel to the second direction relative to the hook to change the degree to which the lock pin blocks the opening.

7. The combination of tabletop sections according to claim 1, comprising a switch for moving the lock pin relative to the hook to change the degree to which the lock pin blocks the opening.

8. The combination of tabletop sections according to claim 7, wherein the table top section comprises first and second ends extending substantially parallel to a first direction, and first and second sides connecting the first and second ends, each of the first and second sides extending substantially parallel to a second direction perpendicular to the first direction, wherein the first connector is at the first end, optionally wherein the first and second sides comprise respective first and second handle portions and wherein the switch is movable in a direction having at least a component parallel to a third direction perpendicular to each of the first and second directions for moving the lock pin relative to the hook to change the degree to which the lock pin blocks the opening, optionally wherein the switch is movable one of linearly and rotationally.

9. The combination of tabletop sections according to claim 8, wherein the first and second handle portions comprise first and second walls defining respective first and second recesses in the first and second sides, and wherein the switch is movably located within a hole in the first wall.

10. The combination of tabletop sections according to claim 9, wherein the switch is movable relative to the first wall between a first position and a second position, wherein when the switch is at the first position a greater degree of the switch is disposed in the first recess than when the switch is at the second position, and wherein the switch is biased towards the first position.

11. The combination of tabletop sections according to claim 1, wherein the lock pin is movable relative to the hook between a first position and a second position, wherein when the lock pin is at the first position the lock pin blocks the opening to a greater degree than when the lock pin is at the second position, and wherein the lock pin is biased towards the first position.

12. The combination of tabletop sections according to claim 11, wherein the switch is movable relative to the first wall between a first position and a second position, wherein when the switch is at the first position a greater degree of the switch is disposed in the first recess than when the switch is at the second position, and wherein the switch is biased towards the first position and wherein movement of the switch from the first position to the second position causes movement of the lock pin from the first position to the second position.

13. The combination of tabletop sections according to claim 1, comprising a second connector for connecting the first tabletop section to the second tabletop section, the second connector having a second hook disposed around a second space and defining a second opening into the second space, and a second lock pin movable relative to the second hook to change a degree to which the second lock pin blocks the second opening, wherein the second connector is spaced from the first connector.

14. The combination of tabletop sections according to claim 13, wherein the second hook lies in a second plane and the second opening is in the second plane.

15. The combination of tabletop sections according to claim 14, wherein the hook lies in a first plane and the opening is in the first plane and wherein the second plane is parallel to and spaced from the first plane.

16. The combination of tabletop sections according to claim 1, wherein the second tabletop section is a tabletop section that is disposed upon, and coupled to, a column of a surgical table.

17. A surgical table comprising the combination of tabletop sections according to claim 1.

18. A tabletop section for a surgical table, the tabletop section comprising first and second ends extending substantially parallel to a first direction, a connector at the first end for connecting the tabletop section to a second tabletop section, the connector comprising a lock pin for locking the connector to the second tabletop section, first and second sides connecting the first and second ends, each of the first and second sides extending substantially parallel to a second direction perpendicular to the first direction, the first and second sides comprising respective first and second handle portions, wherein the first and second handle portions are spaced from the first and second ends, and a switch at the first handle portion movable relative to the first handle portion for moving the lock pin in a direction parallel to the second direction relative to the first handle portion.

19. A tabletop section according to claim 18, wherein the lock pin is restricted to movement in the direction parallel to the second direction.

20. A tabletop section according to claim 18, wherein the switch is movable in a direction having at least a component parallel to a third direction perpendicular to each of the first and second directions for moving the lock pin in the direction parallel to the second direction relative to the first handle portion.

21. A tabletop section according to claim 18, wherein the switch is movable one of linearly and rotationally.

22. A tabletop section according to claim 18, wherein the first and second handle portions comprise first and second walls defining respective first and second recesses in the first and second sides, and wherein the switch is movably located within a hole in the first wall.

23. A tabletop section according to claim 22, wherein the switch is movable relative to the first wall between a first position and a second position, wherein when the switch is at the first position a greater degree of the switch is disposed in the first recess than when the switch is at the second position, and wherein the switch is biased towards the first position.

24. A tabletop section according to claim 18, wherein the connector comprises a hook disposed around a space and defining an opening into the space, and the lock pin is movable relative to the hook to change a degree to which the lock pin blocks the opening.

25. A tabletop section according to claim 24, wherein the hook lies in a first plane and the opening is in the first plane, optionally wherein the first direction is normal to the first plane.

26. A tabletop section according to claim 25, wherein the lock pin is restricted to movement in the first plane.

27. A tabletop section according to claim 24, wherein the lock pin is movable relative to the hook between a first position and a second position, wherein when the lock pin is at the first position the lock pin blocks the opening to a greater degree than when the lock pin is at the second position, and wherein the lock pin is biased towards the first position.

28. A tabletop section according to claim 27, wherein the switch is movable relative to the first wall between a first position and a second position, wherein when the switch is at the first position a greater degree of the switch is disposed in the first recess than when the switch is at the second position, and wherein the switch is biased towards the first position and wherein movement of the switch from the first position to the second position causes movement of the lock pin from the first position to the second position.

* * * * *